US005306392A

United States Patent [19]

Mita

[11] Patent Number: 5,306,392

[45] Date of Patent: Apr. 26, 1994

[54] PROCESS FOR PREPARING PULP USING POTASSIUM-BASED ALKALINE SOLUTION

[76] Inventor: Akio Mita, 4-26-2 Nukui, Nerima-ku, Tokyo, Japan

[21] Appl. No.: 849,386

[22] PCT Filed: Sep. 17, 1991

[86] PCT No.: PCT/JP91/01234

§ 371 Date: May 12, 1992

§ 102(e) Date: May 12, 1992

[87] PCT Pub. No.: WO92/05309

PCT Pub. Date: Apr. 2, 1992

[30] Foreign Application Priority Data

Sep. 14, 1990 [JP] Japan ..... 2-244280

[51] Int. Cl.[5] ..... D21C 3/04

[52] U.S. Cl. ..... 162/76; 162/78; 162/90

[58] Field of Search ..... 162/38, 45, 72, 76, 162/78, 80, 86, 90

[56] References Cited

U.S. PATENT DOCUMENTS

| | | | |
|---|---|---|---|
| 4,466,861 | 8/1984 | Hultman et al. | 162/38 |
| 4,507,172 | 3/1985 | Steltenkamp | 162/38 |
| 4,826,567 | 5/1989 | Gratzl | 162/72 |
| 4,851,082 | 7/1989 | Mita et al. | 162/90 |

*Primary Examiner*—W. Gary Jones
*Assistant Examiner*—Dean T. Nguyen
*Attorney, Agent, or Firm*—Lorusso & Loud

[57] ABSTRACT

A process for the continuous mass-production of chemical pulp from cellulose raw materials without adversely affecting the environment involves digesting the cellulose raw materials at 130° to 200° C. with a cooking liquor containing an alkali, hydrogen peroxide, a chelating agent, an anthraquinone and water. A pulp waste liquor and unbleached pulp are obtained by subjecting the digested cellulose raw materials to solid-liquid separation. The pulp waste liquor is concentrated and burned to obtain an alkali metal carbonate. Calcium oxide is added, if necessary, to the aqueous solution of sodium or/and potassium carbonate for causticization, and hydrogen peroxide, a chelating agent, and an anthraquinone are added to the alkali solution to regenerate the cooking liquor.

4 Claims, 1 Drawing Sheet

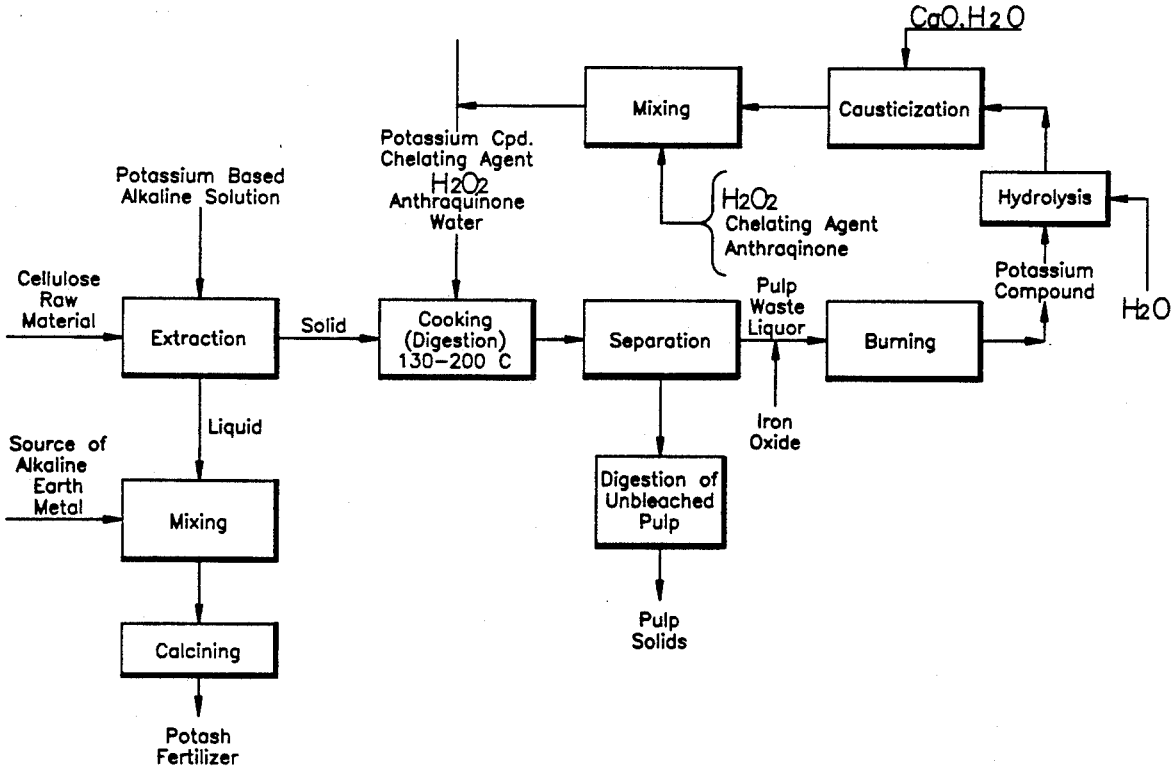

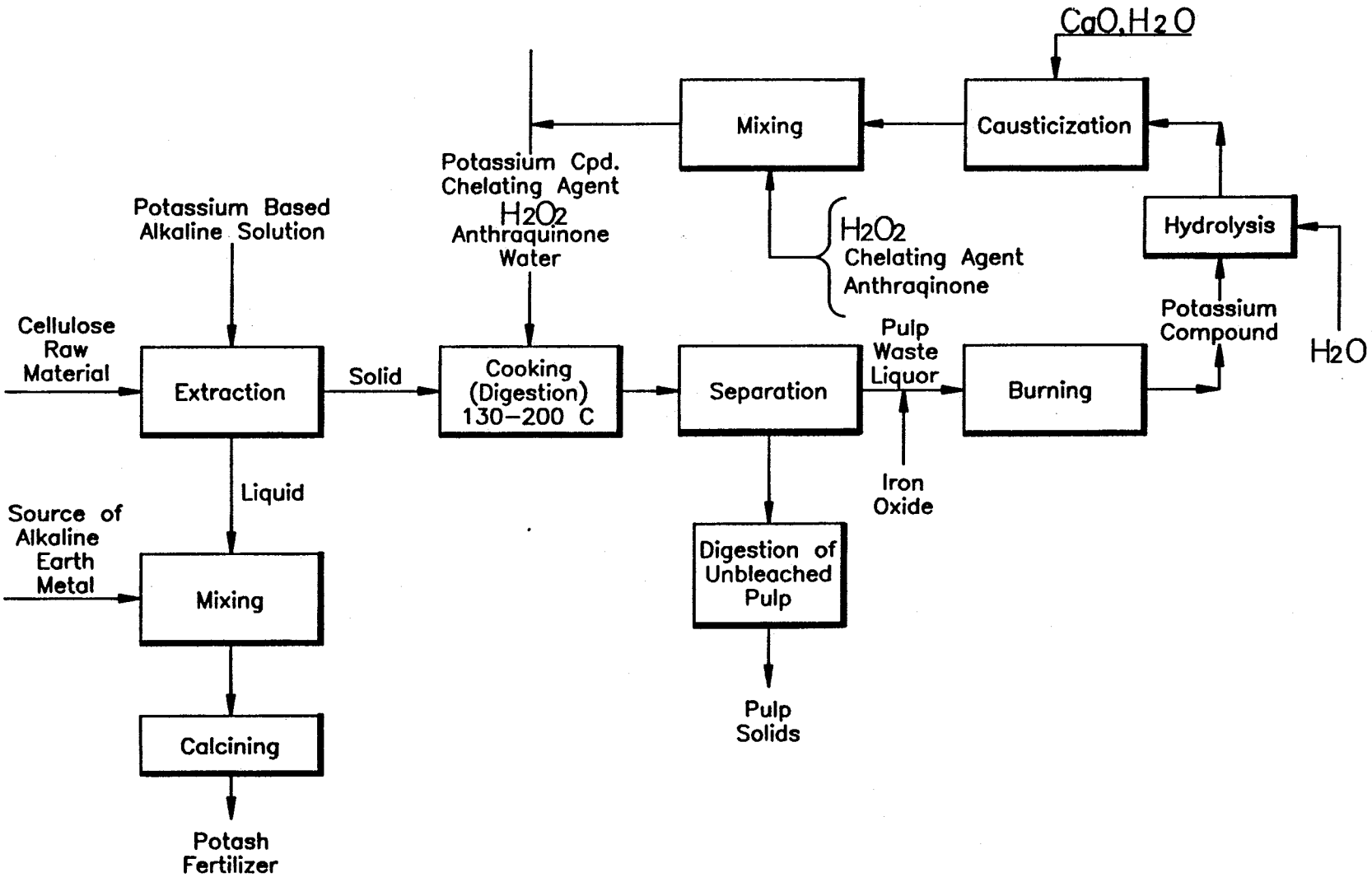
CaO.H2O
Causticization
Hydrolysis
H2O
Potassium Compound
Burning
Mixing
H2O2
Chelating Agent
Anthraqinone
Pulp Waste Liquor
Iron Oxide
Separation
Digestion of Unbleached Pulp
Pulp Solids
Potassium Cpd.
Chelating Agent
H2O2
Anthraquinone
Water
Cooking (Digestion) 130–200 C
Solid
Potassium Based Alkaline Solution
Extraction
Liquid
Mixing
Calcining
Potash Fertilizer
Cellulose Raw Material
Source of Alkaline Earth Metal

PROCESS FOR PREPARING PULP USING POTASSIUM-BASED ALKALINE SOLUTION

TECHNICAL FIELD

The present invention relates to a process for the preparation of chemical pulp in a large quantity and in a continuous manner from cellulose raw materials without spoiling the environment or natural resources.

BACKGROUND ART

Heretofore, a number of processes have been developed with the object of chemically producing pulp from cellulose raw materials. Many processes have been weeded out so far; the processes which are currently available for the preparation of chemical pulp are the AP method (alkali method), SP method (sulfite method), KP method (kraft method) and variants thereof.

The AP method employs a sodium hydroxide aqueous solution (consisting of two components) as a cooking liquor. This method offers the advantages that no malodorous substances are produced, unlike the KP method, and that the chemicals can be recovered from the pulp waste liquor with relative ease. However, it suffers from the disadvantages that the removal of lignin does not readily occur in the process of pulping so that the resulting pulp is poor in strength and the kappa value (an indicator of the content of lignin in pulp having the relationship: lignin (%)=kappa value×0.15) is so remarkably high that a large quantity of chemical is required for bleaching. Hence, this method is not usually applied to the pulping of wood and it is utilized, in part, only for pulping cellulose raw materials derived from non-wooden materials.

The SP method employs an acidic, neutral or alkaline solution of a sulfite as a cooking liquor, and the acidic SP method is particularly superior in its ability to elute lignin so that the unbleached SP pulp is low in kappa value and refining and bleaching are readily carried out; however, the strength and the yield of the pulp are poor. Hence, this method is practically applied for the preparation of dissolution pulp from needle-leaved trees and some broad-leaved trees; however, the demand for such pulp is extremely low. Further, the SP method is not suited for pulping general broad-leaved trees or those needle-leaved trees which are difficult to digest, and the treatment of pulp waste liquor and recovery of the chemical substances used are not easy, so that this method is currently applied only in an extremely small sector of the industry.

The KP method uses an aqueous solution of sodium sulfide and sodium hydroxide (consisting of three components) as a cooking liquor and can pulp various kinds of needle-leaved trees and broad-leaved trees. The resulting pulp is tough and the kappa value is relatively low; however, its bleaching is not so easy. Generally, five- to seven-step bleaching gives a bleached pulp having a high degree of whiteness. Further, this method offers the advantages that sodium sulfide and sodium hydroxide can be recovered for reuse in the cooking liquors by concentrating pulp wastes, burning them in a reducing atmosphere and subjecting them to causticization. In addition, the energy used in burning can also be recovered. For the foregoing reasons, the KP method is today generally used to a remarkably wide extent, and more than 70% of total production of pulp and more than 95% of production of chemical pulp in Japan is by the KP method.

It is to be noted, however, that recent and more severe requirements for protection of the environment and conservation of earth resources, are difficult to meet with the KP method, thus creating an increasing demand to develop a new method for the preparation of pulp, which can serve as a substitute for the KP method currently prevailing in this industry. In other words, while the KP method is superior to the other conventional methods in terms of utilization of resources of cellulose, because the KP method can pulp a wider variety of needle-leaved and broad-leaved trees, the KP method is not suited for pulping so far unavailable trees including many kinds of tropical trees, ceders, deciduous trees and the like and for bleaching pulp therefrom. Further, this method can utilize only a limited number of raw materials, i.e. it is inappropriate for pulping a large number of non-wooden materials including rice plant straw, bagasse, tow, fibers of banana and the like. In addition, the KP method causes by-production of malodorous substances including sulfurous substances such as hydrogen sulfide, methyl mercaptan and the like in exhaust gases resulting from the digestion of pulp, thereby causing air pollution. Furthermore, the bleaching of unbleached KP requires a large quantity of chlorinated bleaching chemicals so that a large amount of organic chlorinated compounds are formed and their presence in waste water from the bleaching step is a huge source of pollution. It should be further noted that, as the purity of product pulp prepared by the XP method is high, a large majority of impurites contained in the cellulose raw materials, such as silica, calcium, magnesium, iron and the like, are eluted out in the digesting step and contaminate the pulp waste liquor; however, no appropriate technique capable of separating and removing those impurities has yet been developed. Therefore, if the chemicals are recovered from the pulp waste liquor and utilized, these impurities are further concentrated, thereby leading to incapability of treating the pulp waste liquor itself. Hence, some cellulose raw materials such as rice plant straw, parts of tropical trees, which are rich in ash components, particularly in silica, can be digested by the KP method; however, the resulting waste liquor cannot be treated in an effective way so that it must be discharged without sufficient treatment. In these respects, the KP method presents many defects as a total system. Accordingly, the pulp industry has been incapable of development notwithstanding an enormous quantity of resources of cellulose that is not yet utilized and a sufficient demand of paper pulp.

Research on new methods for pulping can be broken down into three main groups: (1) methods for preparing pulp by reducing cellulose raw materials in a mechanical way by a disc refiner or the like or in combination with a light degree of chemical treatment; (2) methods for preparing pulp by decomposing non-fibrous materials in the cellulose raw materials by the aid of bacteria or by means of enzymatic treatment; and (3) methods or increasing yield of pulp by adding a small quantity of an auxiliary agent to a cooking liquor to be employed in a conventional chemical pulping method.

The methods (1) for the mechanical preparation of the pulp include the GP method. This method produces a high yield of the pulp but requires a large quantity of energy consumption. Further, the pulp prepared by this method still contains a Considerably large amount of lignin so that a large quantity of a bleaching agent is required for bleaching. The unbleached pulp is too poor in quality to be employed as is. Hence, in recent years, a variant has been adopted which comprises chemically treating the cellulose raw materials to a light extent by using the cooking liquor as employed in the AP method, the SP method, the KP method or the like, or an alkali solution of hydrogen peroxide, in combination with mechanical treatment. This variant method can provide a pulp of quality better than the GP method, in a yield higher than chemical pulp; however, it still has many problems left unsolved, in that it consumes a large quantity of electric power in the preparation of the pulp, a large amount of chlorinated bleaching agent in bleaching, treatment of pulp waste liquor and the like.

The methods (2) for isolating cellulose by biochemical means are recently being extensively studied because the pulp can be produced at ambient atmosphere and temperature or at temperatures close thereto. However, a big problem left unsolved, is that only lignin is separated and removed in an extremely short time without decomposition of cellulose by using a microorganism or an enzyme extracted therefrom.

The methods (3) attempt an increase in the yield of pulp by adding an auxiliary agent such as AQ (anthraquinone) or the like to the cooking liquor employed in the conventional methods, and it is reported that the yield of the pulp can be increased by approximately 0.5% by adding AQ in the KP method, the SP method and the AP method. However, further improvements in the yield are not easy to accomplish.

The present invention has as its object to provide a process and a comprehensive system to produce pulp of good quality in a high yield, which pulp is high in quality and in degree or whiteness and capable of being easily bleached, from a wide range of cellulose raw materials, including wooden and non-wooden materials, and to recover energy and chemicals from the waste liquor in a ready and continuous way, in order to solve the problems with natural resources and with the environment, which are now obstacles to development of the pulp industry.

SUMMARY OF THE INVENTION

Representative cellulose raw materials include bagasse, straw of rice and wheat, Manila hemp, mitsumata (*Edgeworthia crysantha*) and the like, among non-wooden materials, and Japanese red pine, cedar, a Casuarina species, *Leucaena leucocephala* among wooden materials. These cellulose raw materials are digested by using a cooking liquor containing five components consisting of an alkali, or a hydroxide or a carbonate of an alkali metal, particularly sodium and potassium, hydrogen peroxide, a chelating agent, an anthraquinone and water.

As shown in Table 1 below, a pulp having a degree of whiteness (Hunter) of 52.7% and a kappa value of 20.1 was produced from mitsumata in a refined yield of 66.5%, a yield of lees of 2.2% and in a total yield of 68.7%. Further, as shown in the Table 1 below, it is found that the present inventors have succeeded in producing a pulp of higher quality having a higher degree of whiteness in higher yield, compared with the pulp produced from each of the cellulose raw materials by the conventional pulping method.

Further, as a result of extensive studies, it has been found by the present inventors that pulp of good quality can be produced by extracting silica with a potassium-based alkali solution from cellulose raw materials, such as rice straw and so on, which have heretofore been considered inappropriate as raw materials for preparing pulp because they contain impurities such as silica in a considerably large amount, and by digesting the extract residue with a cooking liquor containing five components consisting of an alkali, hydrogen peroxide, a quinone, a chelating agent and water. By subjecting the cellulose raw materials to treatment with an acid, as needed, prior to the extraction of silica, a pulp having a higher degree of whiteness can be produced.

Although the hydrogen peroxide contained in the cooking liquor is easily damaged by the presence of a heavy metal ion, the present inventors have succeeded in recovering from ash, obtained by burning pulp waste liquor, an alkali solution useable for the digestion step, which is substantially free from any heavy metal such as iron and the like. As a result, the present invention avoids the problem of pollution of the environment which would be caused by the discharge of the pulp waste liquor without sufficient treatment. More specifically, the present invention recovers a caustic alkali solution containing little iron by burning a concentrated amount of the pulp waste liquor to which iron oxide has been added, treating the resulting residual ash with hot water, to thereby recover a caustic alkali solution containing a small quantity of iron and a major portion of the iron oxide, and separating and removing precipitates by adding a divalent iron salt to the caustic alkali solution and blowing air into the resulting caustic alkali solution to stir the solution.

Further, the present inventors have succeeded in recovering alkaline hydrogen peroxide for the cooking liquor by applying electricity from a porous graphite electrode to a mixture of the alkali solution, derived from the ash obtained by burning the pulp waste liquor, to generate hydrogen peroxide.

In addition, the present invention provides a potash fertilizer having citric solubility by adding an alkaline earth metal, particularly calcium or magnesium, to the liquid resulting from the extraction of silica from the cellulose raw materials with a potassium-based alkali solution and calcining the resulting liquid. In this manner, a composite phosphate fertilizer can be provided, as needed. Furthermore, a total system can be designed which leaves little solid waste material by utilizing waste materials containing calcium, magnesium and silica.

DESCRIPTION OF THE PREFERRED EMBODIMENTS

As the alkali to be employed for digestion in the first stage of the present invention, in addition to sodium hydroxide, there may be mentioned, for example, hydroxides, oxides, carbonates, peroxides and alkaline salts of an alkali metal, such as potassium hydroxide, sodium carbonate, potassium carbonate, sodium peroxide, potassium peroxide and so on. Among the foregoing, particularly the hydroxide and peroxide of the alkali metal are preferred because they can facilitate digestion. When the carbonate of the alkali metal is employed, the digestion proceeds in a mild fashion; however, it is preferably employed for the pulping of bast raw materials such as mitsumata (white epidermis) because they can provide pulp of high quality in a high yield as shown for the mitsumata in Table 1 below. The hydrogen peroxide to be employed for the method according to the present invention, or a donor of hydrogen peroxide such as a percarbonate and the like, and the alkali are dissolved in water, and at least one chelating agent such as EDTA, DTPA and the like and AQs, such as AQ, methyl-AQ (Me-AQ), ethyl-AQ (Et-AQ) tertiary-butyl-AQ (tBu-AQ), amyl-AQ (Amyl-AQ) and the like are added as stabilizers for the hydrogen peroxide. In this case, the chemicals may be employed in amounts in the range from 10% to 40%, preferably from 10% to 25%, translated into $Na_2O$, relative to the cellulose raw materials on an absolute dry weight basis. The amount of the donor of hydrogen peroxide may be in the range from 0.5% to 12%, preferably from 2% to 7%, translated into $Na_2O$, and the amount of the chelating agent to be added may be in the range from 0.1% to 2%, preferably from 0.2% to 1%. The amount of the quinones may be in the range from 0.01% to 0.5%, preferably from 0.03% to 0.3%.

The term "donor of hydrogen peroxide" used herein is meant to include any substance which forms hydrogen peroxide when dissolved in water, and such donors may include, for example, sodium peroxide, potassium peroxide, peroxo borates such as sodium peroxo borate, peroxo carbonates (such as sodium peroxo carbonate or potassium peroxo carbonate) and other peroxo compounds capable of generating hydrogen peroxide upon hydrolysis. The term "hydrogen peroxide" used herein includes the hydrogen peroxide generated from such a donor of hydrogen peroxide.

As the chelating agent to be employed as the stabilizer for hydrogen peroxide in accordance with the present invention, there may be employed a variety of known compounds, such as EDTA, DTPA, phosphates, and condensed phosphates. As the AQs to be added, there may be employed AQ or an alkyl-AQ such as methyl-, ethyl-, tertiary-butyl-, amyl-AQ and the like. Among those AQs, the tertiary-butyl-AQ and the amyl-AQ can provide particularly remarkable results in improvements in yield in pulping a bast bark such as the mitsumata (white epidermis), as shown for the mitsumata A in Table 1 below. It is found that the preferred results in digestion can be provided by employing water in an amount of from 1.3 liters to 20 liters per kg relative to the solution, from 2 liters to 3.5 liters per kg in the vapor phase, and from 4 liters to 10 liters per kg in the liquid phase.

In accordance with the method according to the present invention, the digestion treatment is usually carried out at temperatures ranging from 130° C. to 200° C., although the optimal temperature may vary in accordance with the type of the cellulose raw material, or non-wooden material, wooden material or materials unlikely to be digested, and in accordance with the type of the alkali. Generally speaking, the non-wooden cellulose raw materials are more readily digested than wooden cellulose raw materials, and the pulping of the non-wooden cellulose raw materials may be effected at temperatures ranging from 130° C. to 160° C. The general wooden cellulose raw materials may be readily pulped at temperatures in the range of from 160° C. to 180° C., while it is preferred to pulp the wooden materials unlikely to be digested at temperatures ranging from 180° C. to 200° C. It is further noted that the pressure at the time of digestion is in the range from approximately 3 $kg/cm^2$ to 10 $kg/cm^2$, secondarily determined on the basis of the temperature for digestion. The period of time during which the optimal maximum temperature is held may be determined on the basis of the degree of difficulty of the digestion of the cellulose raw materials. For digestion in liquid phase, the optimal maximum temperature is held for from 30 minutes to 600 minutes, while the optimal maximum temperature is held for from 10 minutes to 120 minutes in the case of digestion in gaseous phase. In order to allow productivity to be held at a high level, it is preferred to hold the optimal maximum temperature for from 40 minutes to 120 minutes for liquid phase digestion and for from 15 minutes to 40 minutes for gaseous phase digestion.

The digestion product resulting from digestion in the manner as described hereinabove is then preferably subjected to a second-stage digestion treatment, thereby converting the pulp into pulp having a lower kappa value and a higher degree of whiteness. The second-stage digestion may be carried out by using an alkali solution of hydrogen peroxide at temperatures ranging from 20° C. to 110° C. The amount of the alkali hydroxide to be employed in the second-stage treatment with the alkali solution of hydrogen peroxide may be in the range of from 0.3% to 6%, preferably from 0.5% to 2%, when translated into $Na_2O$. In this case, it is preferred to add small amounts of the chelating agent and the AQ to improve the yield and quality of pulp. The amount of water may preferably range from 0.5 to 50 liters per kg of the solution, from 1 to 3 liters per kg in the gaseous phase, and from 5 to 20 liters per kg in the liquid phase. The temperature for treatment may range from 20° C. to 110° C., and it is particularly preferred to set the temperature for treatment in the range of from 70° C. to 90° C. because no pressure-resistant apparatus is required in this temperature range and the treatment can be carried out in a rapid manner. The period of time for treatment may range from 10 minutes to 150 minutes, preferably from 15 minutes to 40 minutes in the vapor phase and from 30 minutes to 90 minutes in the liquid phase. In Table 2 below, abaca, bagasse and cedar are selected as the cellulose raw materials, which are treated under the conditions shown in Table 1 below and then subjected to the two-stage treatment under the conditions shown in Table 2 below. In the examples the concentration of hydrogen peroxide is 3% and 5%, the sodium hydroxide is employed in the amount of 1%, when translated into $Na_2O$, and the treatment is carried out at 90° C. for 1 hour. The kappa value is decreased from 36.2 to 15.2 and the degree of whiteness is elevated from 30.1 to 48.2; decrease in the yield of pulp is low and the yield of pulp is maintained at 96.4%.

The pulp waste liquor is obtained as a by-product in the digestion treatment in the first and second stages. This pulp waste liquor is concentrated and burned, as needed, thereby recovering an alkali carbonate. The alkali carbonate may be subjected to causticization with quick lime in a conventional manner and the alkali can be recovered in the form of an oxide. The sodium ferrate method is modified in such a manner that iron oxide is added to the pulp waste liquor, the mixture is heated at high temperatures, and the resulting alkali salt of a strong acid is hydrolyzed to thereby recover an alkali hydroxide and iron oxide with ease. Hence, it is possible to set up a closed system, as shown in the drawing figure in such a way that pulp can be produced without discharge of any pulp waste liquor from the system.

BRIEF DESCRIPTION OF THE DRAWINGS

The drawing is an explanatory diagram illustrating a process for preparation of chemical pulp and recovery of extracting and cooking chemicals thereof.

In this embodiment of the present invention, the cellulose raw materials are extracted with a potassium-based alkali solution, and the extract liquid is employed for the preparation of a fertilizer having citric solubility on the one hand and the extract residue is employed for the preparation of pulp on the other hand. This embodiment of the present invention can employ, consistent with the object of the present invention, hemp, such as abaca, jute and the like, true grasses such as rice straw, wheat straw, bamboo fibers and the like, tropical trees and other wooden fibers, which have heretofore been thought inappropriate for the preparation of pulp in such a closed system, because they contain an extraordinarily large content of ash, particularly silica, compared with the usual cellulose raw materials (ash, 0.1%–0.3%; silica, 0.01%–0.1%).

In accordance with the present invention, such ash-rich cellulose raw materials (hereinafter also to merely as "cellulose materials") are extracted by using the potassium-based alkali aqueous solution as an extracting agent to allow the silica contained in the cellulose materials to migrate into the extract liquid. The concentration of potassium in the extracting agent may be in the range of from 0.03 to 0.7 mole per liter, preferably from 0.1 to 0.4 mole per liter, when translated into $K_2O$. The extracting agent may optionally contain a small quantity of a water-soluble sodium compound such as sodium hydroxide or the like. As the potassium compound to be used as the extracting agent, there may be employed a variety of potassium compounds. From the point of view of providing potash fertilizers having citric solubility by using the extract residue containing silicon after the extraction treatment, it is preferred that the potassium compound does not contain any element other than oxygen, hydrogen and carbon (for example, sulfur, chlorine and the like). Such compounds include, for example, potassium hydroxide, potassium carbonate, potassium hydrogen carbonate, an water exudate of ash containing potassium carbonate, as a major component, obtainable by burning waste molasses and potassium-based pulp waste liquor, waste water from the bleaching and refining of pulp using the potassium-based alkali aqueous solution, and the like. The temperature for the extraction treatment may range from 0° to 120° C., preferably from 20° to 50° C. The time required for the extraction treatment may be varied in accordance with the kind and state of the cellulose raw materials, the temperature required for the extraction treatment and the like and may be in the range of generally from approximately 0.2 hour to 10 hours, preferably from approximately 0.5 to 3 hours. The extraction treatment may be preferably carried out in a counter-current and multi-stage manner. This manner offers the advantages that a small quantity of an extracting agent is required, the quantity of the residual extraction liquid obtained after the extraction treatment becomes small, and the residual extraction liquid contains silica in a high concentration so that it can be readily treated. Hence, it is preferred to use a multi-stage, counter-current extractor as an apparatus for the extraction treatment. In the extraction treatment, it is desired to reduce the content of siliceous materials in the cellulose raw materials to 1.5% by weight or lower, preferably in the range of from 0.5% to 0.05% by weight, translated into $SiO_2$.

When the cellulose raw materials are to be subjected to the extraction treatment in accordance with the present invention, they are preferably subjected in advance to mechanical treatment, such as crushing, mashing and the like, thereby allowing the extracting agent to more easily infiltrate into the cellulose raw materials and improving the effect to be achieved by contacting the cellulose raw materials with the extracting agent. Further, it is preferable to elute and eliminate heavy metals (Fe, Cu, Mn and so on) in advance by treating the cellulose raw materials with an acid such as an aqueous acidic solution. The elimination of the heavy metals can provide a pulp with improved degree of whiteness and, when hydrogen peroxide is contained in the cooking liquor, it serves to stabilize the hydrogen peroxide. The preferred acidic solution contains an organic acid, such as acetic acid, oxalic acid, lactic acid or the like. The concentration of the acid used may be in the range of from 0.03 to 1 mole per liter, preferably from 0.1 to 0.3 mole per liter (from 0.2% to 10%, preferably from 0.5% to 3%, based on the quantity used). In carrying out the treatment with the acid, it is appropriate to use a multi-stage, counter-current extractor as the apparatus for this treatment.

After the extraction treatment, the resulting cellulose materials are transferred to the digestion step, and the residual extraction liquid containing the siliceous materials is fed to a step for manufacturing a fertilizer having citric solubility.

In manufacturing the fertilizer having citric solubility by using the residual extraction liquid containing the siliceous materials, a material containing an alkaline earth metal is mixed with the residual extraction liquid and the resulting mixture is calcined to yield a glass-like molten material. In this case, the alkaline earth metal may appropriately include calcium and magnesium. As the material containing the alkaline earth metal, there may be employed, for example, calcium carbonate, calcium oxide, calcium carbonate, magnesium oxide, magnesium carbonate, limestone, muscovite, serpentine, calcined phosphorous fertilizer, ammonium magnesium phosphate, calcium phosphate, phosphorous ores, and the like. In accordance with the present invention, however, the use of waste containing the alkaline earth metal is advantageous. Such waste may include, for example, lime sludge, magnesium sludge and so on discharged from sugar manufacturing plants and paper making plants. The lime sludge contains large quantities of water, organic materials and lime, and the magnesium sludge is by-produced in the step for treatment pulp waste water with seawater and quick lime (sea-lime method) and contains a large quantity of water, in addition to magnesium, calcium, sodium and organic materials. Further, in order to supplement the siliceous materials in manufacturing potash fertilizers, silicon-containing materials such as quartz sand, glass chips, fly ash, water residual from blast furnace and potassium liparite may be added to the residual extraction liquid, as needed. Further, as needed, materials containing phosphorous may be added, thereby allowing the preparation of phosphorous-containing composite potash fertilizers having citric solubility. The phosphorous-containing materials include, for example, phosphorous ores, calcined phosphorous, calcium phosphate, ammonium magnesium phosphate and the like. These phosphorous-containing materials may also be employed as calcium-containing materials.

In accordance with the present invention, the materials containing the alkaline earth metal, the phosphorous-containing materials, and the siliceous materials are not necessarily separate from each other, and as a matter of course there may be employed agents containing two components or three components concurrently.

In accordance with the present invention, when the phosphorous ore containing fluorine is added to the silicon-containing residual extraction liquid obtained by the extraction treatment, the addition offers the advantages that the apatite configuration of the phosphorous ore is destroyed due to the presence of potassium within the extraction liquid and an insoluble phosphate is caused to be citric-solubilized, on the one hand, and that the generated fluorine is converted into potassium fluoride. Further, the sources of the alkaline earth metals, the siliceous materials, and the phosphorous-containing materials may contain foreign materials such as iron, sodium, boron and the like, and these foreign materials may serve as trace elements useful for plants as well as serving to reduce the melting point in the calcining step which follows.

In accordance with the present invention, the siliceous residual extraction liquid may be concentrated to reduce its water content to from 30% to 70% by weight, preferably from 40% to 60% by weight, prior to the addition of the alkaline earth metal. This concentrating may employ a multi-effect evaporator having a channel switching mechanism, a cyclone evaporator, an evaporator of an in-liquid burning type, a disc evaporator, a rotary kiln and the like, and these apparatuses may be employed singly or in combination. The siliceous residual extraction liquid may be concentrated to dryness and calcined, thereby allowing use in the form of a solid material (ash) containing potassium and silica as raw material for potash fertilizers.

Although the high temperatures for calcining a mixture containing the silicon, potassium and the alkaline earth metal may be varied to a great extent in accordance with the amounts of the components of the mixture, generally, the temperature may range from 500° to 1,400° C. while the calcining period of time may range from 0.2 hour to 5 hours. Because the melting point of the resulting glass-like molten material decreases to a remarkable extent if large quantities of potassium and the alkaline earth metal are present, the calcining temperature in this case may be in the range of from 500° to 1,100° C. Further, if the content of silicon is high, the calcining temperature may be as high as 800° to 1,400° C. The apparatus for calcination at high temperature may be, for example, a reflection furnace, an electric furnace, a rotary kiln, a smelter boiler, or the like. If the molten material resulting from calcination has a low melting point, the use of the smelter boiler is preferred. In this case, the molten materials are discharged continuously and allowed to drop into a water bath in a continuous manner, thereby cooling the molten materials rapidly to form pieces with fine cracks. The smelter boiler offers the advantage that waste heat can be collected as steam.

The glass-like molten material obtained by the present invention contains $K_2O.xMO.ySiO_2$ as a major component and small quantities of components such as iron, aluminum and the like. In the above formula "M" denotes an alkaline earth metal such as Ca, Mg or the like, "x" denotes a number ranging from 0.3 to 4.0, preferably from 0.5 to 2.0, inclusive, and "y" denotes a number ranging from 1.0 to 3.5, preferably from 1.5 to 3.0. When the preferred examples of the composition of the molten material according to the present invention are represented in % by weight, they contain $K_2O$ in an amount ranging from 4% to 40%, preferably from 8% to 25%; CaO in an amount ranging from 3% to 30%, preferably from 6% to 18%; MgO in an amount ranging from 0% to 30%, preferably from 6% to 18%; and $SiO_2$ in an amount ranging from 10% to 15%, preferably from 1% to 5%. In addition, $Fe_2O_3$ may range from 0% to 15%, preferably from 1% to 5%. The amount of $Al_2O_3$ is preferably 30% or lower, more preferably 10% or lower. It is further noted that the phosphorous component as an optional component may be present in an amount ranging from 4% to 40%, preferably from 8% to 25%. when translated into $P_2O_5$.

In accordance with the present invention, the cellulose materials obtained in the extraction treatment step are then digested with the potassium-based alkaline cooking liquor. Because the cellulose material is first subjected to extraction treatment with the potassium-based alkaline aqueous solution, the present invention can pulp a wide variety of cellulose materials, including wooden and non-wooden materials, with ease.

When the cellulose material, after having been subjected to extraction treatment with the alkaline aqueous solution, is dried while remaining alkaline in the range from pH9.0 to pH13.0, preferably from pH10.0 to 11.5, bacterial degradation can be prevented and the dried material can be stored for a long period of time as pulp raw material.

Although alkali can be readily recovered from the pulp waste liquor in the manner as described hereinabove, the alkali solution can also be recovered in the form of an alkaline hydrogen peroxide solution by electrolyzing the alkali solution while blowing oxygen thereinto and reducing it to hydrogen peroxide. Oxygen is contained in air in the amount of approximately 20% and the concentration of oxygen is preferably increased by separating and removing nitrogen from the air. The alkali is in the form of a carbonate or a hydroxide of sodium or potassium, and the concentration of the alkali may range from 0.03 to 0.7 mole per liter, particularly from 0.1 to 0.4 mole per liter. The alkali in this range as defined hereinabove is preferred for digestion of pulp as well as the recovery and the regeneration of the bleaching chemical solution. As an electrode material, recommended are porous materials having air-permeable and gases-adsorptive properties, for example, porous and air-permeable graphite, platinum or palladium, and the like. The electrolysis may be carried out by means of oxygen and the alkali solution in a conventional manner, thereby yielding hydrogen peroxide in the amount of 0.02 to 0.2 mole per liter and, as a result, recovering the alkaline hydrogen peroxide solution for digestion and bleaching.

The pulp can be digested in such a state that hydrogen peroxide is present together with a heavy metal, e.g. iron, and the heavy metal within the cellulose material extracted with an acid. It is noted, however, that when the pulp waste liquor is concentrated by means of a digesting vessel and then burned in a furnace, contamination with heavy metal from the apparatus entering into the alkali solution cannot be avoided. In particular, when the alkali is recovered by means of the sodium ferrate method, it is difficult to remove iron (trivalent iron) thoroughly and sometimes the iron may be detected in a concentration as high as 50 ppm or higher within the alkali solution.

It has already been described hereinabove that in accordance with the present invention almost all iron contained in the alkali solution is settled to the bottom of a vessel by adding soluble divalent iron salt to the alkali solution prior to electrolysis, while blowing oxygen (air) into the alkali solution. The divalent iron salt to be added, may be, for example, a sulfate, a chloride or the like. The organic acid salt, may be, for example, an acetate, a lactate, a formate or the like. In particular, the use of the organic acid salt is preferred because it can be burned after use in the cooking liquor and decomposed into carbon dioxide and water, which in turn are discharged from the system and do not accumulate at all within the system. The quantity of the divalent iron salt to be employed may range from 0.001 mole to 0.02 mole per liter, preferably from 0.002 mole to 0.01 mole per liter, when translated into FeO, relative to the alkali solution; the reaction may be carried out under atmospheric conditions at a temperature ranging from 0° to 100° C., preferably from 30° to 60° C. The iron salt is converted within the alkali liquid into $Fe(OH)_2$ which settles in the form of a green sediment and is oxidized further to $Fe(OH)_3$. Both compounds are converted into an insoluble iron (III)(II) oxide, or magnetite, by the following reaction, so that the sediment can be separated easily by means of gravity or magnetic force.

$$Fe(OH)_2+2Fe(OH)_3 \rightarrow Fe_3O_4+4H_2O$$

In this instance, the heavy metal ion is allowed to settle together with the iron salt, so that it can be concurrently removed with ease.

The sulfide used for the removal of the heavy metal by sedimentation, to be carried out prior to the aforesaid reaction, may be hydrogen sulfide, sodium sulfide, potassium sulfide or the like. The quantity of the sulfide to be added may range from 1 millimole to 30 millimoles per liter, preferably from 5 millimoles to 20 millimoles per liter. The reaction temperature may be in the range of from 0° to 100° C., preferably from 20° to 60° C. The sediment of copper and the like caused by this reaction can be quantitatively removed. An excessive amount of sulfur incorporated into the system upon treatment with the sulfide can be removed in the form of an iron sulfide by the addition of an iron salt after the completion of the treatment, and an excessive amount of the iron can, in turn, be separated and removed in a substantially quantitative manner by means of oxidation with air, in the manner as described hereinabove.

The scope of the cellulose materials to which the present invention can be applied is so extremely wide, the practice of the present invention is so easy, and the effect of the present invention are remarkable. More specifically, the present invention can pulp cellulose raw materials, heretofore difficult to digest and bleach, such as those derived from previously unavailable woods such as tropical trees and the like and from non-wood origins rich in impurities, as well as needle-leaved trees and broad-leaved trees which can be digested by the conventional AP method, SP method and KP method. In accordance with the present invention, straws such as rice straw, wheat straw and the like; bagasse; bamboos; hemp such as abaca, jute, sisal and the like; and bast epidermis of paper mulberry (*Broussonetia kazinoki*), mitsumata and the like can all be pulped, thereby producing pulp of good quality having a low kappa value. Further, it is to be noted that, as shown in Table 1 below, the present invention can produce pulp capable of one-stage bleaching and having a low kappa value from materials heretofore uneasily digested, such as cedar, which cannot easily be digested by the conventional KP method and which have so far provided only pulp having a low degree of whiteness and a high kappa value and which is difficult to bleach. In addition, the two-stage digestion treatment can provide unbleached pulp having a low kappa value and a high degree of whiteness, as shown in Table 2 below.

The bleaching of such unbleached pulp can be effected with ease, and more than 50% of the chlorinated bleaching agent otherwise required can be saved.

Further, the unbleached pulp having a lower kappa value and a higher degree of whiteness can be produced by treatment via second-stage digestion, as shown in Table 2 below.

The waste liquor obtained by the second-stage treatment can be separated and recovered from the pulp, and it can be employed as an extracting agent for the cellulose raw materials, as needed, or it can be employed as a cooking liquor for the first-stage digestion after supplemented with chemical. The use of the waste liquor as the extracting agent or as the cooking liquor allows remaining chemicals and water to be saved, waste heat to be utilized, the total amount of waste liquor to be reduced, and the concentration to be increased, so that it provides improvements in economy in recovering the chemicals and energy by concentrating the pulp waste liquor and burning the residue. Further, because it is a closed system, it is low in pollution.

The recovery of the chemicals and energy from the pulp waste liquor by-produced in the manner as described hereinabove, including an ash containing the carbonate of the alkali metal, is enabled by burning the pulp waste liquor which generates a large quantity of heat because the pulp waste liquor is rich in organic materials such as lignin, organic acids and the like. As needed, causticization can be employed to give an alkali metal hydroxide which in turn can be converted to an alkali solution of hydrogen peroxide together with oxygen by employing electricity, so that the chemicals can be recovered with ease. In addition, as no sulfur is contained in the waste liquor, combination with the sodium ferrate method enables the provision of an alkali metal hydroxlde without the use of a lime kiln. Furthermore, the incorporation of a high pressure waste heat recovering boiler can generate a large quantity of electric power.

No sulfur-containing gases are contained in the burned exhaust gases so that waste heat can be recovered to a thorough extent. The practice of the present offers the further advantages that no malodorous substances are generated, and the carbon dioxide-containing furnace gases can be employed for incubation and cultivation of chlorella, spirilla and for floriculture.

In accordance with the present invention, pulp can be efficiently produced from the cellulose materials derived from tropical trees containing a high amount of ash, particularly silica, hemps and Poaceae plants, and potash fertilizers having citric solubility can be obtained as a by-product. Hence, the method according to the present invention, as a whole, produces pulp and potash fertilizers, in a process which is free from pollution and high in economy. In particular, the siliceous residual extraction liquid obtainable as a by-product in accordance with the present invention can be used for the preparation of fertilizers by burning it at high temperatures, so that the organic materials contained in the residual extraction liquid can be decomposed and removed, thereby requiring no special treatment for the separation and removal of the organic materials from the residual extraction liquid.

Furthermore, the present invention can employ alkaline earth metals, a variety of industrial wastes containing silicon, and phosphorous ores for the preparation of potash fertilizers having citric solubility and composite fertilizers consisting of potassium and phosphate, as by-products, so that the method according to the present invention is extremely useful for effective utilization of such wastes.

EXAMPLES

The present invention will be described more in detail by way of examples.

EXAMPLE 1

An autoclave was charged with 100 grams of abaca (Manila hemp; based on absolute dry weight) and a cooking liquor containing 150 grams of sodium hydroxide as $Na_2O$, 70 grams of hydrogen peroxide, 10 grams of 1-hydroxyethane-1,1'-diphosphonic acid as a chelating agent, 2 grams of tertiary butylanthraquinone and the remainder water was added in the amount of 7 liters per kg as indicated in Table 1 below. The resulting mixture was digested at 140° C. for 1 hour. The digestion product was separated using a flat screen into a non-digested portion as lees and a single fiber portion as refined pulp. The resulting refined pulp had a degree of whiteness (hereinafter indicated by Hunter representation) of 69.4% and a kappa value of 8.5. The quality of the refined pulp was much greater in strength and better than wood pulp. The yield was 69.8% for the refined pulp and 1.2% for the lees, while the total yield was 71.0%. Further, pulp of good quality having a kappa value of 7.2 and a high degree of whiteness of 82.8% was produced in a yield of 96.1% relative to the previous stage, by treating the refined pulp with a solution in the amount of 10 liters per kg. The solution contained 1% sodium hydroxide as $Na_2O$, 5% hydrogen peroxide, and 0.3% chelating agent and treatment was at 90° C. for 1 hour.

COMPARATIVE EXAMPLE 1

Using abaca of the same lot for comparison with Example 1, it was digested (according to the AP method) at 150° C. for 1 hour by using a sodium hydroxide aqueous solution as shown in Table 1 below under the experiment titled "Abaca", thereby yielding an unbleached pulp having a degree of whiteness of 38.5% and a kappa value of 9.8 in a total yield of 64.4%, inclusive of a yield of refined pulp of 60.2% and a yield of lees of 4.2%.

EXAMPLE 2

An autoclave was charged with 1,000 grams of mitsumata (white epidermis, based on absolute dry weight), and a cooking liquor. The cooking liquor contained 100 grams sodium carbonate as $Na_2O$, 30 grams of hydrogen peroxide, 10 grams of EDTA, 3 grams of tertiary-butyl-AQ, and the remainder water and was added to the mitsumata in the amount of 10 liters per kg as indicated in under the experiment titled "Mitsumata A". The digestion was carried out at 150° C. for 2 hours. The digestion product was separated using a flat screen into a non-digested portion as the lees and a single fiber portion as the refined pulp. The resulting refined pulp had a degree of whiteness of 52.7% and a kappa value of 20.1 and was of a quality better and much stronger in strength than wood pulp. The yield was 66.5% for the refined pulp, 2.2% for the lees, and 68.7% as a whole.

COMPARATIVE EXAMPLE 2

White epldermis of mitsumata of the same lot, for comparison with Example 1, was digested according to the AP method by using a cooking liquor consisting of two components, sodium carbonate and water, in the manner as indicated in Table 1 below under the experiment titled "Mitsumata B", thereby yielding refined pulp having a degree of whiteness of 47.1% and a kappa value of 20.5 in a yield of a refined pulp of 22.9% and in a total yield of 56.0. As described hereinabove, it was thereby demonstrated that the present invention can produce pulp having the degree of whiteness approximately 5% better than that produced by the conventional AP method and that the yield of refined pulp produced by the present invention was approximately 40% higher and the total yield 10% higher than the yields obtained by the conventional AP method, although the kappa value was equivalent.

The experiment titled "Mitsumata B" as indicated in Table 1 below shows an example according to the present invention, in which AQ was employed for digestion in pulping and the experiment titled "Mitsumata C" in Table 1 below shows the use of tertiary butyl-AQ. Both gave improvements in the degree of whiteness of the pulp and in the yield of the refined pulp.

EXAMPLE 3

An autoclave was charged with 1,000 grams (based on absolute dry weight) of bagasse and a cooking liquor containing 150 grams of sodium hydroxide (as $Na_2O$), 30 grams of hydrogen peroxide, 3 grams of AQ, 3 grams of DTPA and the remainder water. The cooling liquor was added to the contents of the autoclave in the amount of 10 liters per kg bagasse. The mixture was then digested at 160° C. for 1 hour, and the digestion product was separated through a flat screen into non-digested materials as lees and a digested single fiber material as refined pulp. The resulting refined pulp was pulp of good quality having a degree of whiteness of 56.2% and a kappa value of 10.5 and the yield of the refined pulp was 43.6%, the yield of the lees was 7.5%, and the total yield was 51.1%.

COMPARATIVE EXAMPLE 3

For comparison with Example 1, the bagasse of the identical lot was digested in accordance with the conventional AP method, thereby producing pulp having a kappa value of 10.6 and a degree of whitenes of 45.3% with a yield of refined pulp of 30.3%.

EXAMPLE 4

An autoclave was charged with 1,000 grams of cedar (in the form of chips based on absolute dry weight) and a cooking liquor, containing 200 grams of sodium hydroxide (as $Na_2O$), 50 grams of hydrogen peroxide, 3 grams of EDTA, 1 gram of AQ and the reaminder water, was added to the chips of cedar. The mixture was digested at a maximum temperature of 180° C. for 60 minutes, and the digestion product was separated through a flat screen into non-digested materials as lees and digested single fiber material as refined pulp.

The resulting refined pulp was found to be pulp of good quality having a degree of whiteness of 30.1% and a kappa value of 43.4. The yield of the refined pulp was 42.5% and the total yield was 43.5%.

COMPARATIVE EXAMPLE 4

For comparison with Example 1, chips of cedar of the identical lot were digested in accordance with the conventional AP method as indicated as Experiment Cedar A in Table 1 below; however, digestion was found difficult and almost the entire product consisted of lees. More specifically, the yield of refined pulp was 31.0%, the yield of the lees was 21.3%, and the total yield was 52.3%. A kappa value of the resulting pulp was extraordinarily high at 120, while the degree of whiteness thereof was extremely low at 20.5%.

EXAMPLE 5

Table 2 shows examples of two-stage digestion treatment according to the present invention in pulping abaca, bagasse and chips of cedar. The first-stage digestion of the abaca, bagasse and the chips cedar was carried out under the conditions shown in Table 1 below. The second-stage digestion was carried out at 90° C. for 1 hour with 10 liters liquor per kg using hydrogen peroxide in the amount of 3% to 5%. The amount of sodium hydroxide was 1% as $Na_2O$ in each experiment.

It was recognized that, as a result, the degree of whiteness of pulp from abaca was increased up to 82.8% while decreasing the kappa value to 6.2, with very small loss of pulp, i.e. with an improved yield of pulp.

The pulp obtained from the cedar chips by the first-stage digestion and the one-stage digestion according to the present invention was subjected to one-stage bleaching with sodium hypochlorite. For each experiment, the conditions for bleaching were a temperature at 50° C. and a bleaching time of 1 hour. The pulp obtained by the one-stage digestion was bleached with ease, thereby producing a degree of whiteness of 77.6% by using effective chlorine in the amount of from 1% to 20%. The pulp obtained by the two-stage digestion was found to be bleached more easily than that obtained by the first-stage digestion, and the one-stage bleaching of the pulp gave a degree of whiteness of 78.6% by decreasing the amount of effective chlorine to a half the amount used for the former and using the effective chlorine in an amount between 1% and 10%.

Further, the bleaching ability of pulp from the bagasse was good. The bleaching at 50° C. for 1 hour using effective chlorine in the amount of 2% gave a degree of whiteness of 78.3%, and the bleaching under the same conditions using effective chlorine in the amount of 3% gave a degree of whiteness of 80%, as shown in Table 2 below. These results indicate that the present invention serves to save chlorine.

EXAMPLE 6

Straw of barley (a silica content of 4.3%) was compressed and flattened, and 500 grams (based on absolute dry weight) of the flattened barley straw were extracted at 50° C. for 5 hours with 10 liters of a potassium hydroxide aqueous solution in the concentration of 20 grams per liter and well washed with water, thereby removing more than 85% of the silica. Thereafter, the extraction residue (solid material reamining after extraction of the barley straw) was digested at the temperature of 160° C. for 1 hour with the liquor in the amount of 10 liters per kg. The cooking liquor contained 15% potassium hydroxide as $K_2O$. The product was an unbleached pulp (having a Hunter degree of whiteness of 35.4% and a kappa value of 7.6) in a yield of 44.1%.

The pulp waste liquor produced as a by-product was concentrated and burned in a conventional manner, and the resulting ash extracted with water, thereby yielding an extract solution containing potassium carbonate as a major component. To the solution was added quick lime, and the mixture was heated and subjected to causticization, thereby recovering a potassium hydroxide aqueous solution, for use with a cooking liquor, in the concentration of 50 grams per liter as $K_2O$. This solution was further subjected to electrolysis using a carbon electrode while allowing an alkali solution and oxygen to pass therethrough, and providing an alkali solution containing hydrogen peroxide in the concentration of 20 grams per liter.

EXAMPLE 7

Rice plant straw having a silica content of content of 15.1% was compressed and flattened in the same manner as in Example 1, and 500 grams (based on absolute dry weight) of the resulting flattened straw were extracted. As an alkaline solution for extraction treatment, there was employed an alkaline solution obtained by adding potassium hydroxide to waste liquor resulting from Pa-stage K-based bleaching of an unbleached pulp (bleaching with an alkali solution of hydrogen peroxide) to obtain a concentration of 25.0 grams per liter as total $K_2O$. The extraction was carried out using a multi-stage, counter-current extractor (10 stages; each stage having the capacity of 12 liters) using the alkali solution at 30° C. in a continuous and counter-current fashion in the amount of 6 liters per kg, thereby extracting and removing more than 95% of the silica. The extract liquor was employed for the preparation of fertilizer having citric solubility.

Next, the extraction residue (solid materials remaining after extraction of the rice plant straw) was subjected to digestion at the temperature of 165° C. for 1 hour using 7 liters per kg of an alkali solution containing sodium hydroxide and tetrahydroanthraquinone (in the amounts of 15% for sodium hydroxide and 0.05% for tetrahydroanthraquinone), thereby giving an unbleached pulp (having a Hunter degree of whiteness of 30.5% and a kappa value of 6.5) in the yield of 42.2%. The pulp waste liquor produced as a by-product was treated in the same manner as in Example 1 and potassium hydroxide for use with a cooking liquor was recovered.

EXAMPLE 8

Bagasse (having a silica content of 0.9%) in the amount of 500 grams (based on absolute dry weight) was treated (at 30° C. for 12 hours) with a lactic acid aqueous solution (in a concentration of 10 grams per liter) and then washed with water. Next, the materials obtained by the treatment with acid were extracted at 30° C. for 3 hours with 10 liters of a potassium hydroxide aqueous solution (containing 20.4 grams per liter as $K_2O$) and then washed with water, thereby extracting and removing more than 80% of the silica content.

Thereafter, the extraction residue was subjected to digestion at 65° C. for 1 hour by using a cooking liquor containing KOH in a concentration of 27.3% as $K_2O$, $H_2O_2$ in a concentration of 3%, t-butylanthraquinone in a concentration 0.1% and 1-hydroxyethane-1,1'-diphosphonic acid in a concentration 0.3% as a chelating agent, relative to the extraction residue (based on dry weight), thereby giving unbleached pulp (having a Hunter degree of whiteness of 62.1% and a kappa value of 4.9) in a yield of 51.2%.

The by-produced pulp waste liquor was treated in accordance with the sodium ferrate method, thereby directly recovering potassium hydroxide for use with a cooking liquor as a solution having the concentration of 45 grams per liter as $K_2O$. The recovered solution was found to contain iron sulfate in the amount of 80 mg per liter as $Fe_2O_3$, so that the iron sulfate was settled to the bottom of the solution as a black sediment by adding iron sulfate thereto in the amount of 200 mg per liter as FeO and passing air through the solution, thereby separating and removing the black sediment in the amount of 3 mg per liter as $Fe_2O_3$ and recovering an alkali solution which was in turn then employed as raw material for forming an alkaline solution of hydrogen peroxide.

TABLE 1

One-Stage Digestion with 5-Component Cooking Liquor & Digestion Results

| | | $H_2O_2$ | Alkali | | Chelating Agent | | Quinones | | Max. Temp. | | Yield | | | Kappa | Degree of Whiteness (Hunter) |
|---|---|---|---|---|---|---|---|---|---|---|---|---|---|---|---|
| | | % | Kind | as $Na_2O$ | Kind | % | Kind | % | °C. | Retained min. | Refined % | Lees % | Total % | Value | % |
| Abaca | A | 7 | NaOH | 15 | HEDP | 1 | tBuAQ | 0.2 | 140 | 60 | 69.8 | 1.2 | 71.0 | 8.5 | 69.8 |
| | B | — | NaOH | 15 | — | — | — | — | 150 | 60 | 60.2 | 4.2 | 64.4 | 9.8 | 38.5 |
| Mitsumata | A | 3 | $Na_2CO_3$ | 10 | EDTA | 1 | tBuAQ | 0.3 | 150 | 120 | 66.5 | 2.2 | 68.7 | 20.1 | 52.7 |
| | B | — | $Na_2CO_3$ | 10 | — | — | — | — | 150 | 240 | 22.9 | 33.1 | 56.0 | 20.5 | 47.1 |
| Bagasse | A | 3 | NaOH | 15 | DTPA | 0.3 | AQ | 0.05 | 160 | 60 | 43.6 | 7.5 | 51.0 | 10.5 | 56.2 |
| | B | — | NaOH | 15 | — | — | — | — | 160 | 60 | 30.3 | 20.3 | 50.6 | 10.6 | 45.3 |
| Straw of Barley | A | 2 | NaOH | 15 | EDTA | 0.3 | AQ | 0.05 | 160 | 60 | 44.0 | 2.1 | 46.1 | 9.1 | 46.2 |
| Straw of Rice | A | 3 | NaOH | 15 | DTPA | 0.3 | THQA | 0.05 | 160 | 60 | 42.1 | 3.2 | 45.3 | 10.1 | 42.1 |
| Cedar | A | 5 | NaOH | 20 | EDTA | 0.3 | AQ | 0.1 | 180 | 60 | 42.5 | 0.9 | 43.4 | 36.2 | 30.1 |
| | B | — | NaOH | 20 | — | — | — | — | 180 | 60 | 31.0 | 21.3 | 52.3 | 120 | 20.5 |
| Ipir-ipir | A | 4.5 | NaOH | 20 | EDTA | 0.3 | AQ | 0.1 | 180 | 60 | 49.5 | 7.5 | 57.0 | 2.1 | 35.0 |

Notes:
HEDP: 1-hydroxyethane-1,1'-diphosphonic acid;
THAQ: tetrahydroanthraquinone;
tBuAQ: tertiary butylanthraquinone

EXAMPLE 9

To 100 ml of the residual extraction solution (containing solids: 89.2 grams per liter; $K_2O$: 24.8 grams per liter; $SiO_2$: 22.3 grams per liter) of the straw of rice plant obtained in Example 2 were added 5.0 grams of a mixture of calcium carbonate with silica (containing 47.6% as $CaCO_3$ CaO and $SiO_2$ in the amount of 15.0%) as a model of sludge as occurring in the step of recovering the chemical liquor from the pulp waste liquor (causticization step), 10 grams of magnesium sludge derived from treatment of waste water from a pulp manufacturing plant in accordance with the sea-lime method (containing water: 77.8%; $Na_2O$: 1.2%; CaO: 1.3%; MgO: 1.3%), and 5 grams of ash produced by coal based steam-power plant stations (containing $SiO_2$: 54.1%; CaO: 3.2%; $Al_2O_3$: 18.5%), and the resulting mixture was thoroughly converted into ash at 450° C. and then heated at 1,200° for 2 hours to melt the mixture. The resulting glass-like molten material was rapidly cooled and pulverized, thereby yielding 13.5 grams of potash fertilizer having citric solubility (containing total $K_2O$: 19.4%; CaO: 19.8%; MgO: 1.4%; $SiO_2$: 42.1%; $Al_2O_3$: 6.9%; $Fe_2O_3$: 1.2%).

EXAMPLE 10

To 100 ml of the residual extraction solution obtained from the straw of rice plant in Example 3 (containing solids: 89.6 grams per liter; $K_2O$: 24.8 grams per liter; $SiO_2$: 22.3 grams per liter) were added 10.0 grams of phosphorous ore powder (containing CaO: 48.2%; $P_2O_5$: 36.1%; F: 3.1%) and 5.0 grams of powder of glass chips (containing $Na_2O$: 16.2%; CaO: 9.0%; $SiO_2$: 72.5%), and the resulting mixture was dried, followed by heating at 1,050° C. for 1 hour to thereby give black-colored glass-like molten material containing a carbonate which, in turn, was rapidly cooled and pulverized. The resulting pulverized material was further finely divided producing a composite fertilizer having citric solubility and containing phosphate and potassium (total $K_2O$: 18.5%; total $K_2O$: 12.7%; $Na_2O$: 4.1%; CaO: 27.0%; $SiO_2$ 32.6%; F: 1.5%) in a yield of 19.5 grams.

TABLE 2

| | NaOH ($Na_2O$) % | $H_2O_2$ % | Yield % | Kappa Value | Degree of Whiteness (Hunter), % |
|---|---|---|---|---|---|
| Abaca | 0 | 0 | 100 | 8.5 | 69.8 |
| Pulp A | 1 | 5 | 96.1 | 7.2 | 82.8 |
| Bagasse | 0 | 0 | 100 | 10.5 | 56.2 |
| Pulp A | 1 | 3 | 95.2 | 6.2 | 71.1 |
| Cedar | 0 | 0 | 100 | 36.2 | 30.1 |
| Pulp A | 1 | 3 | 96.4 | 15.2 | 48.2 |

I claim:

1. A process for the preparation of chemical pulp from a cellulose raw material comprising:

contacting the cellulose raw material, in succession, with an acidic solution and with a potassium-based alkaline solution to extract siliceous materials from the cellulose raw material thereby forming a siliceous extract liquor;

mixing said siliceous extract liquor with an alkaline earth metal and calcining the resulting mixture to produce a potash fertilizer having citric solubility and comprising glass-like materials containing potassium, alkaline earth meal and silica;

cooking the cellulose raw material, from which siliceous materials have been extracted, at 130° C. to 200° C. in a cooking liquor containing a potassium compound, hydrogen peroxide, a chelating agent, an anthraquinone and water to produce a digestion product;

separating said digestion product into a pulp waste liquor and an unbleached pulp;

concentration and burning said pulp waste liquor to recover the potassium compound;

forming an aqueous solution of the recovered potassium compound and adding calcium oxide to said aqueous solution for causticization; and adding hydrogen peroxide, said chelating agent and said anthraquinone to the causticized aqueous solution to regenerate the cooking liquor.

2. A process as claimed in claim 1, further comprising:

digesting the unbleached pulp at 20° C. to 100° C. with an alkali solution of hydrogen peroxide to lower kappa value and increase whiteness of the pulp.

3. A process as claimed in claim 1, further comprising:

adding iron oxide to said pulp waste liquor whereby said burning of the resulting pulp waste liquor produces potassium ferrate; and hydrolyzing said potassium ferrate to recover the iron oxide and to form said aqueous solution of the potassium compound.

4. A process as claimed in claim 1, wherein said alkaline earth metal is added to said siliceous extract liquor in the form of an alkaline earth metal phosphate.

* * * * *